US008889931B2

(12) United States Patent
Luo et al.

(10) Patent No.: US 8,889,931 B2
(45) Date of Patent: Nov. 18, 2014

(54) PROCESSES FOR PREPARING LOW VISCOSITY LUBRICATING OIL BASE STOCKS

(75) Inventors: Shuji Luo, Bridgewater, NJ (US); Abhimanyu Onkar Patil, Westfield, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 349 days.

(21) Appl. No.: 13/298,814

(22) Filed: Nov. 17, 2011

(65) Prior Publication Data

US 2013/0130952 A1 May 23, 2013

(51) Int. Cl.

| | |
|---|---|
| ***C07C 9/00*** | (2006.01) |
| ***C07C 2/02*** | (2006.01) |
| ***C10M 107/10*** | (2006.01) |

(52) U.S. Cl.

CPC ..... *C10M 107/10* (2013.01); *C10N 2230/54* (2013.01); *C10N 2240/10* (2013.01); *C10M 2205/0285* (2013.01); *C10N 2230/02* (2013.01); *C10N 2220/022* (2013.01); *C10N 2270/00* (2013.01); *C10N 2230/74* (2013.01)

USPC ..... 585/18; 585/520; 585/530; 585/532

(58) Field of Classification Search

USPC ..... 585/18, 520, 530, 532

See application file for complete search history.

(56) References Cited

U.S. PATENT DOCUMENTS

| | | | |
|---|---|---|---|
| 3,036,003 | A | 5/1962 | Verdol |
| 3,172,892 | A | 3/1965 | LeSuer et al. |
| 3,219,666 | A | 11/1965 | Norman et al. |
| 3,316,177 | A | 4/1967 | Dorer, Jr. et al. |
| 4,234,435 | A | 11/1980 | Meinhardt et al. |
| 4,889,647 | A | 12/1989 | Rowan et al. |

(Continued)

FOREIGN PATENT DOCUMENTS

| | | |
|---|---|---|
| EP | 1040115 | 6/2004 |
| WO | 9931113 | 6/1999 |
| WO | 0034211 | 6/2000 |

OTHER PUBLICATIONS

Peter Wasserscheid, Siegfried Grimm, Randolf D. Kohn and Matthias Haufe, "Synthesis of Synthetic Lubricants by Trimerization of 1-Decene and 1-Dodecene with Homogeneous Chromium Catalysts", Adv. Synth. Catal., 2001, 343(8), 814-818.

(Continued)

*Primary Examiner* — Vishal Vasisth

(74) *Attorney, Agent, or Firm* — Robert A. Migliorini

(57) ABSTRACT

A process for the oligomerization of $C_6$-$C_{24}$ alpha-olefins to give a polyolefin product comprising at least 50 mole % of alphaolefin trimers. The process involves contacting two or more $C_6$-$C_{24}$ alpha-olefins with a catalyst in a solvent at a temperature below 120° C. and under reaction conditions sufficient to produce the alphaolefin trimers. The polyolefin product has a viscosity ($Kv_{100}$) from 2 to 8 cSt at 100° C., and a viscosity index (VI) from 100 to 160. The polyolefin product comprises at least two alphaolefin trimers, each having a different total carbon number. The process further involves hydrogenating the polyolefin product to form a lubricating oil base stock. The lubricating oil base stock can be used in formulating lubricating oils. The lubricating oils are advantageous as engine oils that can improve engine fuel efficiency.

19 Claims, 6 Drawing Sheets

(56) References Cited

U.S. PATENT DOCUMENTS

| | | | | |
|---|---|---|---|---|
| 4,978,464 | A | 12/1990 | Coyle et al. | |
| 5,705,458 | A | 1/1998 | Roby et al. | |
| 6,824,671 | B2 * | 11/2004 | Goze et al. | 208/19 |
| 6,844,290 | B1 * | 1/2005 | Maas et al. | 502/167 |
| 7,279,609 | B2 | 10/2007 | Mihan | |
| 7,544,850 | B2 * | 6/2009 | Goze et al. | 585/525 |
| 2002/0183574 | A1 | 12/2002 | Dixon et al. | |
| 2006/0211904 | A1 * | 9/2006 | Goze et al. | 585/520 |
| 2009/0326296 | A1 | 12/2009 | Goze et al. | |

OTHER PUBLICATIONS

Randolf D. Kohn, Matthias Haufe, Gabriele Kociok-Kohn, Siegfried Grimm, Peter Wasserscheid and Wilhelm Keim, "Selective Trimerization of a-Olefins with Triazacyclohexane Complexes of Chromium as Catalyst", Angew. Chem. Int. Ed., 2000, 39, No. 23, pp. 4337-4339.

Randolf D. Kohn and Gabriele Kociok-Kohn, Cr" and Fe" Complexes with n3-1,3,5-Triazacyclohexane Ligands, Angew. Chem. Int. Ed. Engl., 1994, 33, No. 18, pp. 1877-1878.

* cited by examiner

PROCESSES FOR PREPARING LOW VISCOSITY LUBRICATING OIL BASE STOCKS

FIELD

This disclosure relates to a process for the oligomerization of $C_6$-$C_{24}$ alpha-olefins to give a polyolefin product comprising at least 50 mole % of alphaolefin trimers, and to a lubricating oil base stock and lubricating oil derived from the polyolefin product.

BACKGROUND

Lubricants in commercial use today are prepared from a variety of natural and synthetic base stocks admixed with various additive packages and solvents depending upon their intended application. The base stocks typically include mineral oils, polyalphaolefins (PAO), gas-to-liquid base oils (GTL), silicone oils, phosphate esters, diesters, polyol esters, and the like.

A major trend for passenger car engine oils (PCEOs) is an overall improvement in quality as higher quality base stocks become more readily available. Typically the highest quality PCEO products are formulated with base stocks such as PAOs or GTL stocks.

The PAOs are synthesized by cationic oligomerization with the Lewis acid catalyst like $BF_3$/R—OH using 1-decene as feedstock followed by hydrogenation of the obtained oligomers. However, the products obtained in this process contain besides $C_{30}$ oligomers significant amounts of dimers, tetramers, pentamers. The $C_{20}$ dimer products add significant volatility because of their lower vapor pressure. The higher oligomers increase the pour points of the materials.

Attempts in making low viscosity PAOs by metallocene catalysts identified lead catalysts that produce mixtures of PAO dimer, trimer, tetramer and higher oligomers. The trimer needs to be isolated from the dimer and higher viscosity fluids to achieve desired viscosity and Noack volatility.

There is a need for new base stock with low viscosity, low Noack volatility and superior low temperature properties.

The present disclosure also provides many additional advantages, which shall become apparent as described below.

SUMMARY

This disclosure relates in part to a process for the oligomerization of $C_6$-$C_{24}$ alpha-olefins to give a polyolefin product comprising at least 50 mole % of alphaolefin trimers. The process comprises contacting two or more $C_6$-$C_{24}$ alpha-olefins with a catalyst in a solvent at a temperature below 120° C. and under reaction conditions sufficient to produce the alphaolefin trimers. The polyolefin product has a viscosity ($Kv_{100}$) from 2 to 8 at 100° C., and a viscosity index (VI) from 100 to 160. The polyolefin product comprises at least two, preferably at least three, alphaolefin trimers, each having a different total carbon number.

This disclosure also relates in part to a polyolefin product produced by the above described process.

This disclosure further relates in part to hydrogenating the polyolefin product produced by the above process to form a lubricating oil base stock.

This disclosure yet further relates in part to a lubricating oil base stock produced by the above described process.

This disclosure also relates in part to a lubricating oil comprising a lubricating oil base stock prepared by the above described process.

Improved fuel efficiency can also be attained in an engine lubricated with a lubricating oil by using as the lubricating oil a formulated oil in accordance with this disclosure. The lubricating oils of this disclosure are particularly advantageous as passenger vehicle engine oil (PVEO) products. The improved selectivity to alphaolefin trimers allows the composition to be less volatile because of lack of dimer product and with better low temperature properties because of lack of higher oligomers responsible for higher pour points to lubricating oils.

Further objects, features and advantages of the present disclosure will be understood by reference to the following drawings and detailed description.

DETAILED DESCRIPTION

Figure 1:
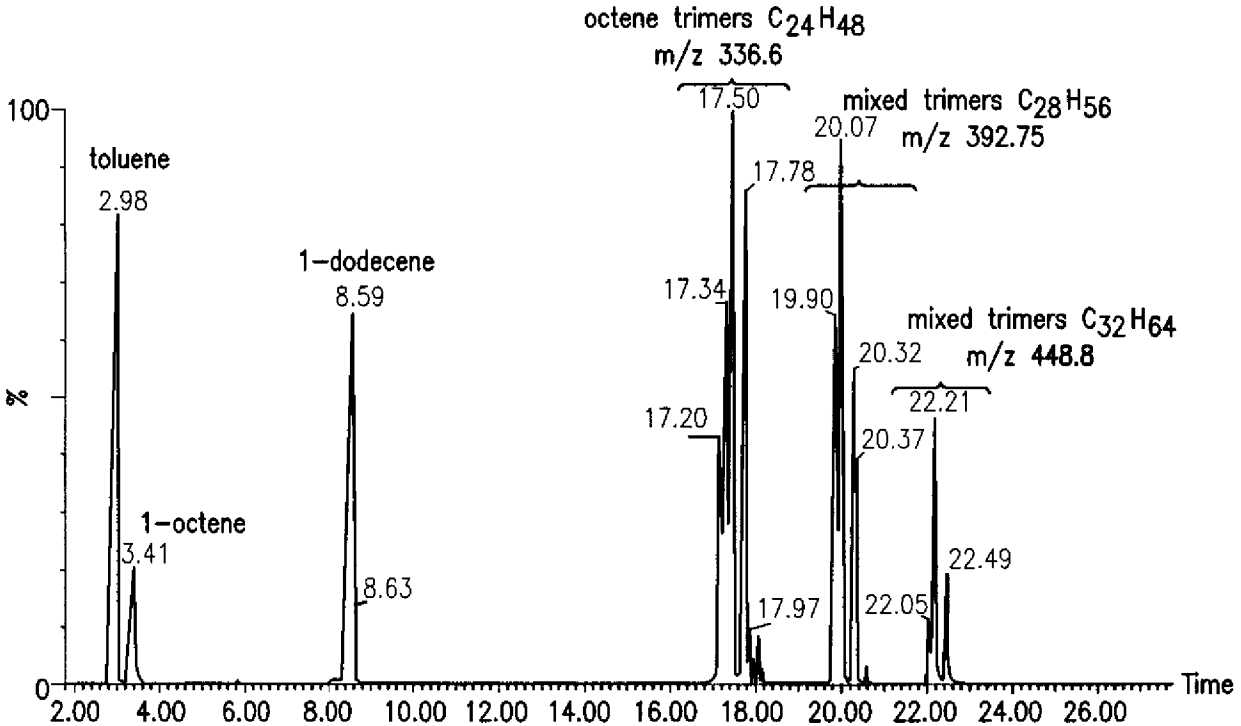
FIG. 1 depicts gas chromatograph-mass spectrograph GC-MS of the product of Example 1 showing the presence of various oligomers including $C_{24}$, $C_{28}$ and $C_{32}$ carbons numbers.

All numerical values within the detailed description and the claims herein are modified by "about" or "approximately" the indicated value, and take into account experimental error and variations that would be expected by a person having ordinary skill in the art.

The polyolefin products produced in accordance with the process of this disclosure possess low viscosity, low Noack volatility and superior low temperature properties. The polyolefin products of this disclosure exhibit excellent bulk flow properties.

The polyolefin products have a viscosity ($Kv_{100}$) from 2 to 8 cSt at 100° C., preferably from 2.1 to 6 cSt at 100° C., and more preferably from 2.5 to 4 cSt at 100° C. The polyolefin products have a viscosity index (VI) from 100 to 160, preferably from 105 to 155, and more preferably from 110 to 150. As used herein, viscosity ($Kv_{100}$) is determined by ASTM D 445-01, and viscosity index (VI) is determined by ASTM D 2270-93 (1998).

The polyolefin products produced in accordance with the process of this disclosure have a Noack volatility of no greater than 20 percent, preferably no greater than 18 percent, and more preferably no greater than 15 percent. As used herein, Noack volatility is determined by ASTM D-5800.

The polyolefin products produced in accordance with the process of this disclosure are comprised of at least 50 mole %, preferably at least 75 mole %, and more preferably at least 90 mole %, of alphaolefin trimers. By alphaolefin trimer is meant a product formed by the reaction of alpha-olefin molecules.

The polyolefin products are comprised of at least two, e.g., 2, 3, 4 or more, different alphaolefin trimers, each having a different total carbon number. The alphaolefin trimers typically have a carbon number selected from $C_{18}$, $C_{19}$, $C_{20}$, $C_{21}$, $C_{22}$, $C_{23}$, $C_{24}$, $C_{25}$, $C_{26}$, $C_{27}$, $C_{28}$, $C_{29}$, $C_{30}$, $C_{31}$, $C_{32}$, $C_{33}$, $C_{34}$, $C_{35}$, $C_{36}$, $C_{37}$, $C_{38}$, $C_{39}$, $C_{40}$, $C_{41}$, $C_{42}$, $C_{43}$, $C_{44}$, $C_{45}$, $C_{46}$, $C_{47}$, $C_{48}$, $C_{49}$, $C_{50}$, $C_{51}$, $C_{52}$; $C_{53}$, $C_{54}$, $C_{55}$, $C_{56}$, $C_{57}$, $C_{58}$, $C_{59}$ and $C_{60}$. In a preferred embodiment, the alphaolefin trimers have a carbon number selected from $C_{24}$, $C_{25}$, $C_{26}$, $C_{27}$, $C_{28}$, $C_{29}$, $C_{30}$, $C_{31}$, $C_{32}$, $C_{33}$, $C_{34}$, $C_{35}$ and $C_{36}$.

The total carbon number of the alphaolefin trimers can be odd numbered in addition to even numbered. For example, an alphaolefin trimer can have a total carbon number selected from $C_{19}$, $C_{21}$, $C_{23}$, $C_{25}$, $C_{27}$, $C_{29}$, $C_{31}$, $C_{33}$, $C_{35}$, $C_{37}$, $C_{39}$, $C_{41}$, $C_{43}$, $C_{45}$, $C_{47}$, $C_{49}$, $C_{51}$, $C_{53}$, $C_{55}$, $C_{57}$ and $C_{59}$. In a preferred embodiment, an alphaolefin trimer can have a total carbon number selected from $C_{25}$, $C_{27}$, $C_{29}$, $C_{31}$, $C_{33}$ and $C_{35}$.

As indicated above, the process of this disclosure involves the oligomerization of $C_6$-$C_{24}$ alpha-olefins to give a polyolefin product comprising at least 50 mole % of alphaolefin trimers. The process involves contacting two or more $C_6$-$C_{24}$ alpha-olefins with a catalyst in a solvent at a temperature below 120° C. and under reaction conditions sufficient to produce the alphaolefin trimers. The catalyst is preferably a single site trimerization catalyst, e.g., a complex of a chromium compound and a 1,3,5-triazacyclohexane. The polyolefin product has a viscosity ($Kv_{100}$) from 2 to 8 at 100° C., and a viscosity index (VI) from 100 to 160. The polyolefin product comprises at least two alphaolefin trimers, preferably at least three alphaolefin trimers, each having a different total carbon number.

The process of the present disclosure selectively converts an alpha-olefin to trimers. The selective conversion of alpha-olefin to trimer is preferably at least 75 mol %, e.g., 80-99 mol %, more preferably at least 90 mol %, especially at least 95 mol %. The yields of dimers, tetramers or other oligomers are reduced compared with known oligomerization processes.

Illustrative $C_6$-$C_{24}$ alpha-olefins useful in the process of this disclosure comprise 1-octene and 1-dodecene, or a mixture comprising 1-octene/1-dodecene, and the like.

In an embodiment, the two or more $C_6$-$C_{24}$ alpha-olefins can include singly two or more of 1-decene, 1-octene, 1-dodecene, 1-hexene, 1-tetradecene, 1-octadecene, 1-hexadecene, and 1-eicosene, or a mixture comprising two or more of 1-decene, 1-octene, 1-dodecene, 1-hexene, 1-tetradecene, 1-octadecene, 1-hexadecene, and 1-eicosene. The alpha-olefin that may be trimerized according to the process of the present disclosure preferably has 6 or more carbon atoms and more preferably has from 8-20 carbon atoms. The alpha-olefin may be a straight or branched chain olefin.

The concentration of the $C_6$-$C_{24}$ alpha-olefin starting materials can vary over a wide range, and need only be that minimum amount necessary to form the desired lubricating oil base stock. In general, depending on the size of the reaction mixture, $C_6$-$C_{24}$ alpha-olefin starting material concentrations in the range of from 1 weight percent or less to 99 weight percent or greater, should be sufficient for most processes.

Illustrative catalysts that can be used in the process of this disclosure include, for example, chromium/triazacyclohexane catalyst. The catalyst preferably comprises a source of chromium and is a single site trimerization catalyst. The single site trimerization catalyst can be used in conventional amounts needed to catalyze the alphaolefin oligomerization reaction.

A preferred catalyst useful in the process of the present disclosure is a complex of a chromium compound and a 1,3,5-triazacyclohexane (hereinafter referred to as a chromium/triazacyclohexane catalyst). Such catalysts and the preparation thereof are described, for example, in WO 00/34211, the disclosure of which is incorporated herein be reference in its entirety.

In the oligomerization process of the present disclosure, the alpha-olefin is contacted with a catalyst in the presence of a solvent. The catalyst may be activated by a modifier such as an alkyl aluminoxane. Preferably, the aluminoxane is methyl alumoxane (MAO). The solvent is suitably a saturated hydrocarbon or an aromatic solvent which does not actively participate in the reaction. Examples of solvents that may be used include, for example, n-hexane, n-heptane, cyclohexane, benzene, toluene and the xylenes. The contacting of the alpha-olefin and the catalyst is suitably carried out in an atmosphere inert under the process conditions such as nitrogen, argon and the like.

The oligomerization process is carried out at relatively low temperatures of less than 120° C., suitably in the range from −30° C. to +100° C., preferably in the range from −25 to +25° C., e.g., 0° C. At temperatures of the order of 0° C., the trimerization reaction goes through to completion with minimum deactivation of the catalyst.

The process of the present disclosure may be carried out by initially mixing a solution of the alpha-olefin and the trimerization catalyst, cooling this solution down and then gradually adding a solution of the catalyst modifier to this mixture whilst allowing the reaction mixture to warm up. During the warming up of the reaction mixture, it may change color. The reaction mixture so formed is then neutralized by the addition of a strong acid, e.g., hydrochloric acid, thereto. This results in a biphasic mixture comprising an aqueous and an organic phase. The biphasic mixture is separated using a centrifuge to recover the organic phase. The organic phase is dried and the volume % of trimers in the polyolefin product is determined e.g. by gas chromatography.

The polyolefin product may then be catalytically hydrogenated to form lubricating oil base stock. The hydrogenation may be carried out in solution. The catalyst may be any suitable hydrogenation catalyst, but is preferably, a palladium catalyst supported on activated carbon or a Raney nickel catalyst. The hydrogenation is suitably carried out at elevated pressure, e.g., from 2000-10000 KPa, preferably from 4500-8000 KPa. The hydrogenation reaction is suitably carried out at a temperature in the range from 15-200° C., preferably from 30-70° C. The duration of the hydrogenation reaction may be a few minutes to several days. After the hydrogenation reaction is complete, the reaction mixture is cooled down, depressurized and the solvent used removed by vacuum distillation. The purity of the hydrogenated product can be determined by gas chromatography and the viscosity of the resulting lubricant measured by rotary viscosimetry.

Reaction conditions for the oligomerization, such as temperature, pressure and contact time, may also vary greatly and any suitable combination of such conditions may be employed herein. The reaction temperature may range between −30° C. to 120° C., and preferably between −25° C. to 100° C., and more preferably between −20° C. to 25° C. Normally the reaction is carried out under ambient pressure and the contact time may vary from a matter of seconds or minutes to a few hours or greater. The reactants can be added to the reaction mixture or combined in any order. The stir time employed can range from 1 to 240 hours, preferably from 2 to 72 hours, and more preferably from 4 to 48 hours.

In an embodiment, this disclosure includes the synthesis of $C_{23}$, $C_{32}$, and other specific carbon number based low viscosity PAOs. The PAOs can be synthesized via selective trimerization of linear alpha olefins (combination of single and mixed olefins) as described herein. Such compounds cannot be synthesized using selective trimerization of linear alpha olefins using single feed. For example, 1-octene/1-dodecene mixture can be oligomerized to obtain not only $C_{24}$ ($C_8$+$C_8$+$C_8$) and $C_{36}$ ($C_{12}$+$C_{12}$+$C_{12}$) but also $C_{28}$ ($C_8$+$C_8$+$C_{12}$) and $C_{32}$ ($C_8$+$C_{12}$+$C_{12}$) carbon number based PAO. As another example, 1-octene/1-decene mixture can be oligomerized to obtain not only $C_{24}$ ($C_8$+$C_8$+$C_8$) and $C_{30}$ ($C_{10}$+$C_{10}$+$C_{10}$) but also $C_{26}$ ($C_8$+$C_8$+$C_{10}$) and $C_{28}$ ($C_8$+$C_{10}$+$C_{10}$) carbon number based PAO, and 1-decene/1-dodecene mixture can be oligomerized to obtain not only $C_{30}$ ($C_{10}$+$C_{10}$+$C_{10}$) and $C_{36}$ ($C_{12}$+$C_{12}$+$C_{12}$) but also $C_{32}$ ($C_{10}$+$C_{10}$+$C_{12}$) and $C_{34}$ ($C_{10}$+$C_{12}$+$C_{12}$) carbon number based PAO.

Besides even number of alpha-olefins, this disclosure includes odd number alpha-olefins, such as 1-nonene to obtain $C_{27}$ ($C_9$+$C_9$+$C_9$) carbon based PAO and, in combination with $C_8$, $C_{10}$ or $C_{12}$ based alpha-olefins, to obtain other specific carbon number based PAOs to optimize PAOs as far as balance of viscosity and volatility of the fluid. The viscosity volatility balance is sensitive to carbon numbers of PAO.

This disclosure is directed in part to selective trimerization of alpha-olefins (single or mixed-feed) to obtain low viscosity low volatility PAO using preferably single-site trimerization catalysts. The selective process of this disclosure overcomes traditional Schulz-Flory limitations of some of the organometallic catalysts including metallocenes, and enables direct synthesis of PAOs with target viscosity and volatility. The low viscosity and low volatility of the lubricating oil base stocks of this disclosure contributes to improved fuel economy.

An illustrative process of this disclosure is depicted below.

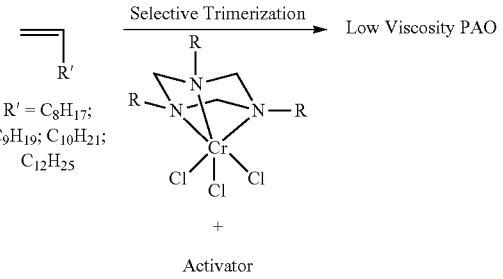

Examples of techniques that can be employed to characterize the compositions formed by the process described above include, but are not limited to, analytical gas chromatography, nuclear magnetic resonance, thermogravimetric analysis, inductively coupled plasma mass spectrometry, differential scanning calorimetry, volatility and viscosity measurements.

This disclosure provides lubricating oils useful as engine oils and in other applications characterized by excellent low volatility and low temperature characteristics. The lubricating oils are based on high quality base stocks including a major portion of a hydrocarbon base fluid of this disclosure. The lubricating oil base stock is in the lube oil boiling range, typically between 100 to 450° C. In the present specification and claims, the terms base oil(s) and base stock(s) are used interchangeably.

The viscosity-temperature relationship of a lubricating oil is one of the critical criteria which must be considered when selecting a lubricant for a particular application. Viscosity index (VI) is an empirical, unitless number which indicates the rate of change in the viscosity of an oil within a given temperature range. Fluids exhibiting a relatively large change in viscosity with temperature are said to have a low viscosity index. A low VI oil, for example, will thin out at elevated temperatures faster than a high VI oil. Usually, the high VI oil is more desirable because it has higher viscosity at higher temperature, which translates into better or thicker lubrication film and better protection of the contacting machine elements.

In another aspect, as the oil operating temperature decreases, the viscosity of a high VI oil will not increase as much as the viscosity of a low VI oil. This is advantageous because the excessive high viscosity of the low VI oil will decrease the efficiency of the operating machine. Thus high VI (HVI) oil has performance advantages in both high and low temperature operation. VI is determined according to ASTM method D 2270-93 [1998]. VI is related to kinematic viscosities measured at 40° C. and 100° C. using ASTM Method D 445-01.

Lubricating Oil Base Stocks

The polyolefin product produced in accordance with the process of this disclosure may be catalytically hydrogenated as described herein to form a lubricating oil base stock. Lubricating oil base stocks useful in lubricating oils of this disclosure comprise such a polyolefin product that has been catalytically hydrogenated.

The base stock is preferably present in the lubricating oils of this disclosure in an amount from 50 to 99 weight percent, preferably from 70 to 98 weight percent, and more preferably from 80 to 95 weight percent.

Other Additives

The formulated lubricating oil useful in the present disclosure may additionally contain one or more of the other commonly used lubricating oil performance additives including but not limited to dispersants, other detergents, corrosion inhibitors, rust inhibitors, metal deactivators, other anti-wear agents and/or extreme pressure additives, anti-seizure agents, wax modifiers, viscosity index improvers, viscosity modifiers, fluid-loss additives, seal compatibility agents, other friction modifiers, lubricity agents, anti-staining agents, chromophoric agents, defoamants, demulsifiers, emulsifiers, densifiers, wetting agents, gelling agents, tackiness agents, colorants, and others. For a review of many commonly used additives, see Klamann in Lubricants and Related Products, Verlag Chemie, Deerfield Beach, Fla.; ISBN 0-89573-177-0. Reference is also made to "Lubricant Additives Chemistry and Applications" edited by Leslie R. Rudnick, Marcel Dekker, Inc. New York, 2003 ISBN: 0-8247-0857-1.

The types and quantities of performance additives used in combination with the instant disclosure in lubricant compositions are not limited by the examples shown herein as illustrations.

Viscosity Improvers

Viscosity improvers (also known as Viscosity Index modifiers, and VI improvers) increase the viscosity of the oil composition at elevated temperatures which increases film thickness, while having limited effect on viscosity at low temperatures.

Suitable viscosity improvers include high molecular weight hydrocarbons, polyesters and viscosity index improver dispersants that function as both a viscosity index improver and a dispersant. Typical molecular weights of these polymers are between 10,000 to 1,000,000, more typically 20,000 to 500,000, and even more typically between 50,000 and 200,000.

Examples of suitable viscosity improvers are polymers and copolymers of methacrylate, butadiene, olefins, or alkylated styrenes. Polyisobutylene is a commonly used viscosity index improver. Another suitable viscosity index improver is polymethacrylate (copolymers of various chain length alkyl methacrylates, for example), some formulations of which also serve as pour point depressants. Other suitable viscosity index improvers include copolymers of ethylene and propylene, hydrogenated block copolymers of styrene and isoprene, and polyacrylates (copolymers of various chain length acrylates, for example). Specific examples include styrene-isoprene or styrene-butadiene based polymers of 50,000 to 200,000 molecular weight.

The amount of viscosity modifier may range from zero to 8 wt %, preferably zero to 4 wt %, more preferably zero to 2 wt % based on active ingredient and depending on the specific viscosity modifier used.

Antioxidants

Typical anti-oxidant include phenolic anti-oxidants, aminic anti-oxidants and oil-soluble copper complexes.

The phenolic antioxidants include sulfurized and non-sulfurized phenolic antioxidants. The terms "phenolic type" or "phenolic antioxidant" used herein includes compounds having one or more than one hydroxyl group bound to an aromatic ring which may itself be mononuclear, e.g., benzyl, or poly-nuclear, e.g., naphthyl and spiro aromatic compounds. Thus "phenol type" includes phenol per se, catechol, resorcinol, hydroquinone, naphthol, etc., as well as alkyl or alkenyl and sulfurized alkyl or alkenyl derivatives thereof, and bisphenol type compounds including such bi-phenol compounds linked by alkylene bridges sulfuric bridges or oxygen bridges. Alkyl phenols include mono- and poly-alkyl or alkenyl phenols, the alkyl or alkenyl group containing from 3-100 carbons, preferably 4 to 50 carbons and sulfurized derivatives thereof, the number of alkyl or alkenyl groups present in the aromatic ring ranging from 1 to up to the available unsatisfied valences of the aromatic ring remaining after counting the number of hydroxyl groups bound to the aromatic ring.

Generally, therefore, the phenolic anti-oxidant may be represented by the general formula:

$$(R)_x—Ar—(OH)_y$$

where Ar is selected from the group consisting of:

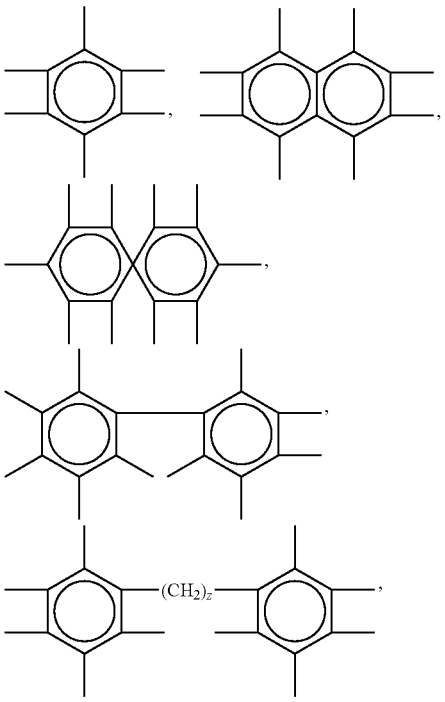

-continued

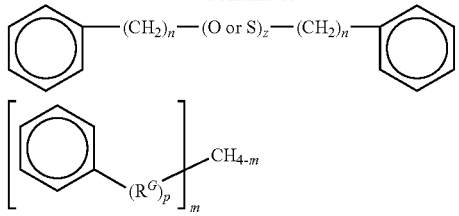

wherein R is a $C_3$-$C_{100}$ alkyl or alkenyl group, a sulfur substituted alkyl or alkenyl group, preferably a $C_4$-$C_{50}$ alkyl or alkenyl group or sulfur substituted alkyl or alkenyl group, more preferably $C_3$-$C_{100}$ alkyl or sulfur substituted alkyl group, most preferably a $C_4$-$C_{50}$ alkyl group, $R^g$ is a $C_1$-$C_{100}$ alkylene or sulfur substituted alkylene group, preferably a $C_2$-$C_{50}$ alkylene or sulfur substituted alkylene group, more preferably a $C_2$-$C_2$ alkylene or sulfur substituted alkylene group, y is at least 1 to up to the available valences of Ar, x ranges from 0 to up to the available valances of Ar-y, z ranges from 1 to 10, n ranges from 0 to 20, and m is 0 to 4 and p is 0 or 1, preferably y ranges from 1 to 3, x ranges from 0 to 3, z ranges from 1 to 4 and n ranges from 0 to 5, and p is 0.

Preferred phenolic anti-oxidant compounds are the hindered phenolics and phenolic esters which contain a sterically hindered hydroxyl group, and these include those derivatives of dihydroxy aryl compounds in which the hydroxyl groups are in the o- or p-position to each other. Typical phenolic anti-oxidants include the hindered phenols substituted with $C_1$+ alkyl groups and the alkylene coupled derivatives of these hindered phenols. Examples of phenolic materials of this type 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-t-butyl-4-heptyl phenol; 2-methyl-6-t-butyl-4-dodecyl phenol; 2,6-di-t-butyl-4 methyl phenol; 2,6-di-t-butyl-4-ethyl phenol; and 2,6-di-t-butyl 4-alkoxy phenol; and

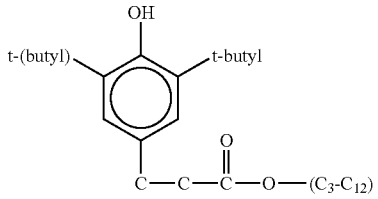

Phenolic type anti-oxidants are well known in the lubricating industry and commercial examples such as Ethanox® 4710, Irganox® 1076, Irganox® L1035, Irganox® 1010, Irganox® L109, Irganox® L118, Irganox® L135 and the like are familiar to those skilled in the art. The above is presented only by way of exemplification, not limitation on the type of phenolic anti-oxidants which can be used.

The phenolic anti-oxidant can be employed in an amount in the range of 0.1 to 3 wt %, preferably 1 to 3 wt %, more preferably 1.5 to 3 wt % on an active ingredient basis.

Aromatic amine anti-oxidants include phenyl-α-naphthyl amine which is described by the following molecular structure:

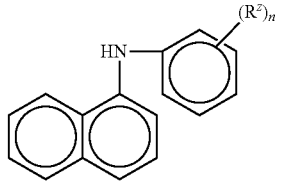

wherein $R^z$ is hydrogen or a $C_1$ to $C_{14}$ linear or $C_3$ to $C_{14}$ branched alkyl group, preferably $C_1$ to $C_{10}$ linear or $C_3$ to $C_{10}$ branched alkyl group, more preferably linear or branched $C_6$ to $C_8$ and n is an integer ranging from 1 to 5 preferably 1. A particular example is Irganox L06.

Other aromatic amine anti-oxidants include other alkylated and non-alkylated aromatic amines such as aromatic monoamines of the formula $R^8R^9R^{10}N$ where $R^8$ is an aliphatic, aromatic or substituted aromatic group, $R^9$ is an aromatic or a substituted aromatic group, and $R^{10}$ is H, alkyl, aryl or $R^{11}S(O)_xR^{12}$ where $R^{11}$ is an alkylene, alkenylene, or aralkylene group, $R^{12}$ is a higher alkyl group, or an alkenyl, aryl, or alkaryl group, and x is 0, 1 or 2. The aliphatic group $R^8$ may contain from 1 to 20 carbon atoms, and preferably contains from 6 to 12 carbon atoms. The aliphatic group is a saturated aliphatic group. Preferably, both $R^8$ and $R^9$ are aromatic or substituted aromatic groups, and the aromatic group may be a fused ring aromatic group such as naphthyl. Aromatic groups $R^8$ and $R^9$ may be joined together with other groups such as S.

Typical aromatic amines anti-oxidants have alkyl substituent groups of at least 6 carbon atoms. Examples of aliphatic groups include hexyl, heptyl, octyl, nonyl, and decyl. Generally, the aliphatic groups will not contain more than 14 carbon atoms. The general types of such other additional amine anti-oxidants which may be present include diphenylamines, phenothiazines, imidodibenzyls and diphenyl phenylene diamines. Mixtures of two or more of such other additional aromatic amines may also be present. Polymeric amine anti-oxidants can also be used.

Another class of anti-oxidant used in lubricating oil compositions and which may also be present are oil-soluble copper compounds. Any oil-soluble suitable copper compound may be blended into the lubricating oil. Examples of suitable copper antioxidants include copper dihydrocarbyl thio- or dithio-phosphates and copper salts of carboxylic acid (naturally occurring or synthetic). Other suitable copper salts include copper dithiacarbamates, sulphonates, phenates, and acetylacetonates. Basic, neutral, or acidic copper Cu(I) and or Cu(II) salts derived from alkenyl succinic acids or anhydrides are known to be particularly useful.

Such anti-oxidants may be used individually or as mixtures of one or more types of anti-oxidants, the total amount employed being an amount of 0.50 to 5 wt %, preferably 0.75 to 3 wt % (on an as-received basis).

Detergents

In addition to the alkali or alkaline earth metal salicylate detergent which is an essential component in the present disclosure, other detergents may also be present. While such other detergents can be present, it is preferred that the amount employed be such as to not interfere with the synergistic effect attributable to the presence of the salicylate. Therefore, most preferably such other detergents are not employed.

If such additional detergents are present, they can include alkali and alkaline earth metal phenates, sulfonates, carboxylates, phosphonates and mixtures thereof. These supplemental detergents can have total base number (TBN) ranging from neutral to highly overbased, i.e. TBN of 0 to over 500, preferably 2 to 400, more preferably 5 to 300, and they can be present either individually or in combination with each other in an amount in the range of from 0 to 10 wt %, preferably 0.5 to 5 wt % (active ingredient) based on the total weight of the formulated lubricating oil. As previously stated, however, it is preferred that such other detergent not be present in the formulation.

Such additional other detergents include by way of example and not limitation calcium phenates, calcium sulfonates, magnesium phenates, magnesium sulfonates and other related components (including borated detergents).

Dispersants

During engine operation, oil-insoluble oxidation byproducts are produced. Dispersants help keep these byproducts in solution, thus diminishing their deposition on metal surfaces. Dispersants may be ashless or ash-forming in nature. Preferably, the dispersant is ashless. So called ashless dispersants are organic materials that form substantially no ash upon combustion. For example, non-metal-containing or borated metal-free dispersants are considered ashless. In contrast, metal-containing detergents discussed above form ash upon combustion.

Suitable dispersants typically contain a polar group attached to a relatively high molecular weight hydrocarbon chain. The polar group typically contains at least one element of nitrogen, oxygen, or phosphorus. Typical hydrocarbon chains contain 50 to 400 carbon atoms.

A particularly useful class of dispersants are the alkenylsuccinic derivatives, typically produced by the reaction of a long chain substituted alkenyl succinic compound, usually a substituted succinic anhydride, with a polyhydroxy or polyamino compound. The long chain group constituting the oleophilic portion of the molecule which confers solubility in the oil, is normally a polyisobutylene group. Many examples of this type of dispersant are well known commercially and in the literature. Exemplary U.S. patents describing such dispersants are U.S. Pat. Nos. 3,172,892; 3,219,666; 3,316,177 and 4,234,435. Other types of dispersant are described in U.S. Pat. Nos. 3,036,003 and 5,705,458.

Hydrocarbyl-substituted succinic acid compounds are popular dispersants. In particular, succinimide, succinate esters, or succinate ester amides prepared by the reaction of a hydrocarbon-substituted succinic acid compound preferably having at least 50 carbon atoms in the hydrocarbon substituent, with at least one equivalent of an alkylene amine are particularly useful.

Succinimides are formed by the condensation reaction between alkenyl succinic anhydrides and amines. Molar ratios can vary depending on the amine or polyamine. For example, the molar ratio of alkenyl succinic anhydride to TEPA can vary from 1:1 to 5:1.

Succinate esters are formed by the condensation reaction between alkenyl succinic anhydrides and alcohols or polyols. Molar ratios can vary depending on the alcohol or polyol used. For example, the condensation product of an alkenyl succinic anhydride and pentaerythritol is a useful dispersant.

Succinate ester amides are formed by condensation reaction between alkenyl succinic anhydrides and alkanol amines. For example, suitable alkanol amines include ethoxylated polyalkylpolyamines, propoxylated polyalkylpolyamines and polyalkenylpolyamines such as polyethylene polyamines. One example is propoxylated hexamethylenediamine.

The molecular weight of the alkenyl succinic anhydrides will typically range between 800 and 2,500. The above products can be post-reacted with various reagents such as sulfur, oxygen, formaldehyde, carboxylic acids such as oleic acid, and boron compounds such as borate esters or highly borated dispersants. The dispersants can be borated with from 0.1 to 5 moles of boron per mole of dispersant reaction product.

Mannich base dispersants are made from the reaction of alkylphenols, formaldehyde, and amines. Process aids and catalysts, such as oleic acid and sulfonic acids, can also be part of the reaction mixture. Molecular weights of the alkylphenols range from 800 to 2,500.

Typical high molecular weight aliphatic acid modified Mannich condensation products can be prepared from high molecular weight alkyl-substituted hydroxyaromatics or $HN(R)_2$ group-containing reactants.

Examples of high molecular weight alkyl-substituted hydroxyaromatic compounds are polypropylphenol, polybutylphenol, and other polyalkylphenols. These polyalkylphenols can be obtained by the alkylation, in the presence of an alkylating catalyst, such as $BF_3$, of phenol with high molecular weight polypropylene, polybutylene, and other polyalkylene compounds to give alkyl substituents on the benzene ring of phenol having an average 600-100,000 molecular weight.

Examples of $HN(R)_2$ group-containing reactants are alkylene polyamines, principally polyethylene polyamines. Other representative organic compounds containing at least one $HN(R)_2$ group suitable for use in the preparation of Mannich condensation products are well known and include the mono- and di-amino alkanes and their substituted analogs, e.g., ethylamine and diethanol amine; aromatic diamines, e.g., phenylene diamine, diamino naphthalenes; heterocyclic amines, e.g., morpholine, pyrrole, pyrrolidine, imidazole, imidazolidine, and piperidine; melamine and their substituted analogs.

Examples of alkylene polyamine reactants include ethylenediamine, diethylene triamine, triethylene tetraamine, tetraethylene pentaamine, pentaethylene hexamine, hexaethylene heptaamine, heptaethylene octaamine, octaethylene nonaamine, nonaethylene decamine, and decaethylene undecamine and mixture of such amines having nitrogen contents corresponding to the alkylene polyamines, in the formula $H_2N—(Z—NH—)_nH$, mentioned before, Z is a divalent ethylene and n is 1 to 10 of the foregoing formula. Corresponding propylene polyamines such as propylene diamine and di-, tri-, tetra-, pentapropylene tri-, tetra-, penta- and hexaamines are also suitable reactants. The alkylene polyamines are usually obtained by the reaction of ammonia and dihalo alkanes, such as dichloro alkanes. Thus the alkylene polyamines obtained from the reaction of 2 to 11 moles of ammonia with 1 to 10 moles of dichloroalkanes having 2 to 6 carbon atoms and the chlorines on different carbons are suitable alkylene polyamine reactants.

Aldehyde reactants useful in the preparation of the high molecular products useful in this disclosure include the aliphatic aldehydes such as formaldehyde (also as paraformaldehyde and formalin), acetaldehyde and aldol (β-hydroxybutyraldehyde). Formaldehyde or a form aldehyde-yielding reactant is preferred.

Preferred dispersants include borated and non-borated succinimides, including those derivatives from mono-succinimides, bis-succinimides, and/or mixtures of mono- and bis-succinimides, wherein the hydrocarbyl succinimide is derived from a hydrocarbylene group such as polyisobutylene having a Mn of from 500 to 5000 or a mixture of such hydrocarbylene groups. Other preferred dispersants include succinic acid-esters and amides, alkylphenol-polyamine-coupled Mannich adducts, their capped derivatives, and other related components. Such additives may be used in an amount of 0.1 to 20 wt %, preferably 0.1 to 8 wt %, more preferably 1 to 6 wt % (on an as-received basis) based on the weight of the total lubricant.

Pour Point Depressants

Conventional pour point depressants (also known as lube oil flow improvers) may also be present. Pour point depressant may be added to lower the minimum temperature at which the fluid will flow or can be poured. Examples of suitable pour point depressants include alkylated naphthalenes polymethacrylates, polyacrylates, polyarylamides, condensation products of haloparaffin waxes and aromatic compounds, vinyl carboxylate polymers, and terpolymers of dialkylfumarates, vinyl esters of fatty acids and allyl vinyl ethers. Such additives may be used in amount of 0.0 to 0.5 wt %, preferably 0 to 0.3 wt %, more preferably 0.001 to 0.1 wt % on an as-received basis.

Corrosion Inhibitors/Metal Deactivators

Corrosion inhibitors are used to reduce the degradation of metallic parts that are in contact with the lubricating oil composition. Suitable corrosion inhibitors include aryl thiazines, alkyl substituted dimercapto thiodiazoles thiadiazoles and mixtures thereof. Such additives may be used in an amount of 0.01 to 5 wt %, preferably 0.01 to 1.5 wt %, more preferably 0.01 to 0.2 wt %, still more preferably 0.01 to 0.1 wt % (on an as-received basis) based on the total weight of the lubricating oil composition.

Seal Compatibility Additives

Seal compatibility agents help to swell elastomeric seals by causing a chemical reaction in the fluid or physical change in the elastomer. Suitable seal compatibility agents for lubricating oils include organic phosphates, aromatic esters, aromatic hydrocarbons, esters (butylbenzyl phthalate, for example), and polybutenyl succinic anhydride and sulfolane-type seal swell agents such as Lubrizol 730-type seal swell additives. Such additives may be used in an amount of 0.01 to 3 wt %, preferably 0.01 to 2 wt % on an as-received basis.

Anti-Foam Agents

Anti-foam agents may advantageously be added to lubricant compositions. These agents retard the formation of stable foams. Silicones and organic polymers are typical antifoam agents. For example, polysiloxanes, such as silicon oil or polydimethyl siloxane, provide antifoam properties. Antifoam agents are commercially available and may be used in conventional minor amounts along with other additives such as demulsifiers; usually the amount of these additives combined is less than 1 percent, preferably 0.001 to 0.5 wt %, more preferably 0.001 to 0.2 wt %, still more preferably 0.0001 to 0.15 wt % (on an as-received basis) based on the total weight of the lubricating oil composition.

Inhibitors and Antirust Additives

Anti-rust additives (or corrosion inhibitors) are additives that protect lubricated metal surfaces against chemical attack by water or other contaminants. One type of anti-rust additive is a polar compound that wets the metal surface preferentially, protecting it with a film of oil. Another type of anti-rust additive absorbs water by incorporating it in a water-in-oil emulsion so that only the oil touches the surface. Yet another type of anti-rust additive chemically adheres to the metal to produce a non-reactive surface. Examples of suitable additives include zinc dithiophosphates, metal phenolates, basic metal sulfonates, fatty acids and amines. Such additives may be used in an amount of 0.01 to 5 wt %, preferably 0.01 to 1.5 wt % on an as-received basis.

In addition to the ZDDP anti-wear additives which are essential components of the present disclosure, other anti-wear additives can be present, including zinc dithiocarbamates, molybdenum dialkyldithiophosphates, molybdenum dithiocarbamates, other organo molybdenum-nitrogen complexes, sulfurized olefins, etc.

The term "organo molybdenum-nitrogen complexes" embraces the organo molybdenum-nitrogen complexes described in U.S. Pat. No. 4,889,647. The complexes are reaction products of a fatty oil, dithanolamine and a molybdenum source. Specific chemical structures have not been assigned to the complexes. U.S. Pat. No. 4,889,647 reports an infrared spectrum for a typical reaction product of that disclosure; the spectrum identifies an ester carbonyl band at 1740 $cm^{-1}$ and an amide carbonyl band at 1620 $cm^{-1}$. The fatty oils are glyceryl esters of higher fatty acids containing at least 12 carbon atoms up to 22 carbon atoms or more. The molybdenum source is an oxygen-containing compound such as ammonium molybdates, molybdenum oxides and mixtures.

Other organo molybdenum complexes which can be used in the present disclosure are tri-nuclear molybdenum-sulfur compounds described in EP 1 040 115 and WO 99/31113 and the molybdenum complexes described in U.S. Pat. No. 4,978,464.

In the above detailed description, the specific embodiments of this disclosure have been described in connection with its preferred embodiments. However, to the extent that the above description is specific to a particular embodiment or a particular use of this disclosure, this is intended to be illustrative only and merely provides a concise description of the exemplary embodiments. Accordingly, the disclosure is not limited to the specific embodiments described above, but rather, the disclosure includes all alternatives, modifications, and equivalents falling within the true scope of the appended claims. Various modifications and variations of this disclosure will be obvious to a worker skilled in the art and it is to be understood that such modifications and variations are to be included within the purview of this application and the spirit and scope of the claims.

The following are examples of the present disclosure and are not to be construed as limiting.

EXAMPLES

Example 1

In a nitrogen-filled mBraun glove box, to a 15 milliliter vial equipped with a stir bar was charged methylaluminoxane (1.158 grams 10 wt % toluene solution), 1-octene/1-dodecene mixed olefins (80:20 by wt, 2.4 grams). The mixture was stirred vigorously at ambient temperature. A toluene solution of a N,N',N"-tridodecyltriazacyclohexane chromium trichloride complex (1.5 grams 1 wt % solution) was then added while stirring. After 18 hours, the reaction was quenched by methanol. GC-MS analysis showed that product consist of not only $C_{24}$ ($C_8$+$C_8$+$C_8$), but also has $C_{28}$ ($C_8$+$C_8$+$C_{12}$) and $C_{32}$ ($C_8$+$C_{12}$-$C_{12}$) carbon numbers. FIG. 1 depicts gas chromatograph-mass spectrograph GC-MS of the product showing the presence of various oligomers including $C_{24}$, $C_{28}$ and $C_{32}$ carbons numbers.

Example 2

Figure 2:
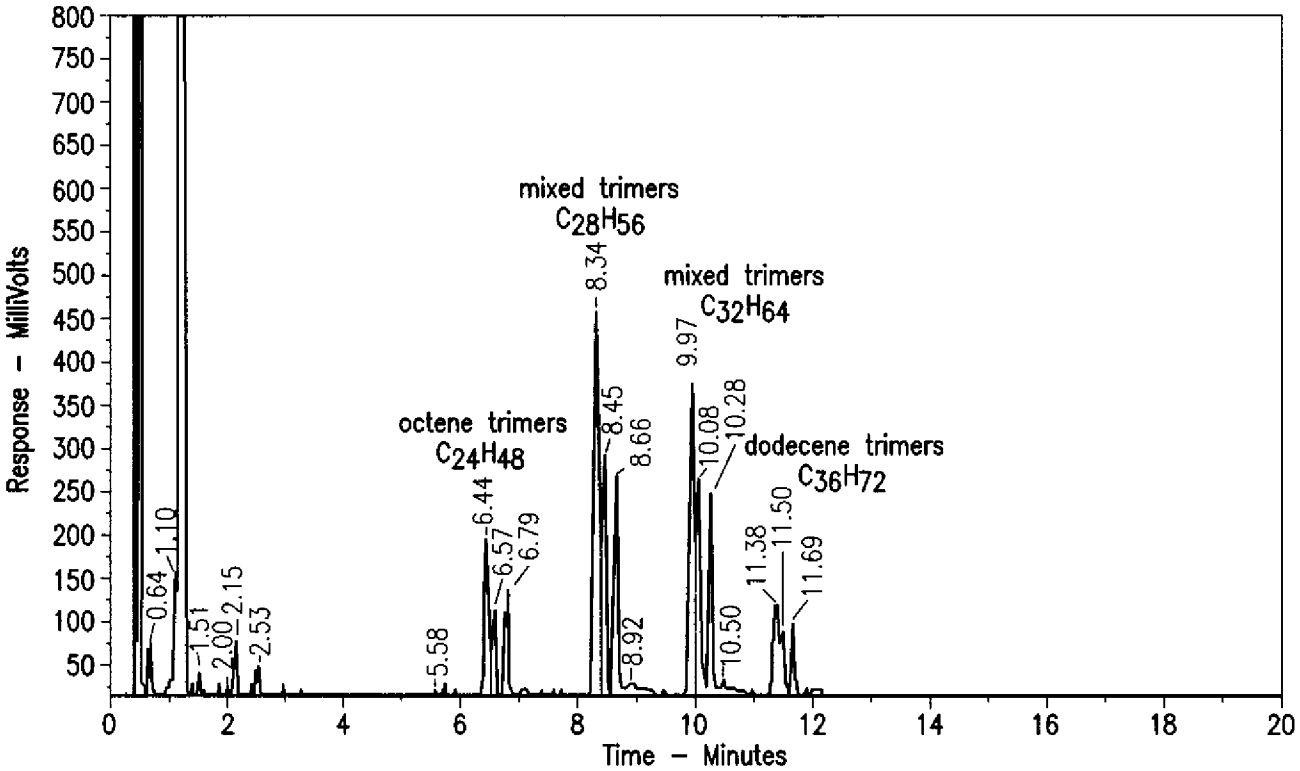
FIG. 2 depicts a gas chromatograph CC of the product of Example 2 showing the presence of various oligomers having $C_{24}$, $C_{28}$, $C_{32}$ and $C_{36}$ carbon numbers.

In a nitrogen-filled mBraun glove box, to a bottle equipped with a stir bar was charged N,N',N"-tridodecyltriazacyclohexane chromium trichloride (0.1 grams), toluene (10 grams), 1-octene (14.95 grams, FW 112.21, 0.133 moles) and 1-dodecene (22.43 grams, FW 168.32, 0.133 moles). The ratio of 1-octene and 1-dodecene was 1:1. The bottle was sealed and put into a cold toluene bath equilibrized at 4° C. The mixture was stirred vigorously to generate a homogeneous purple solution. Methylaluminoxane (7.73 grams 10 wt % toluene solution) was then added. The temperature was kept at 4° C. for overnight, after which GC determined that 21% olefins had been converted into trimers. The trimers consist of $C_{24}$ ($C_8$+$C_8$+$C_8$), $C_{28}$ ($C_8$+$C_8$+$C_{12}$), $C_{32}$ ($C_8$+$C_{12}$+$C_{12}$) and $C_{36}$ ($C_{12}$+$C_{12}$+$C_{12}$) carbon numbers. FIG. 2 depicts a gas chromatograph GC of the product showing the presence of various oligomers having $C_{24}$, $C_{28}$, $C_{32}$ and $C_{36}$ carbon numbers.

Example 3

Figure 3:
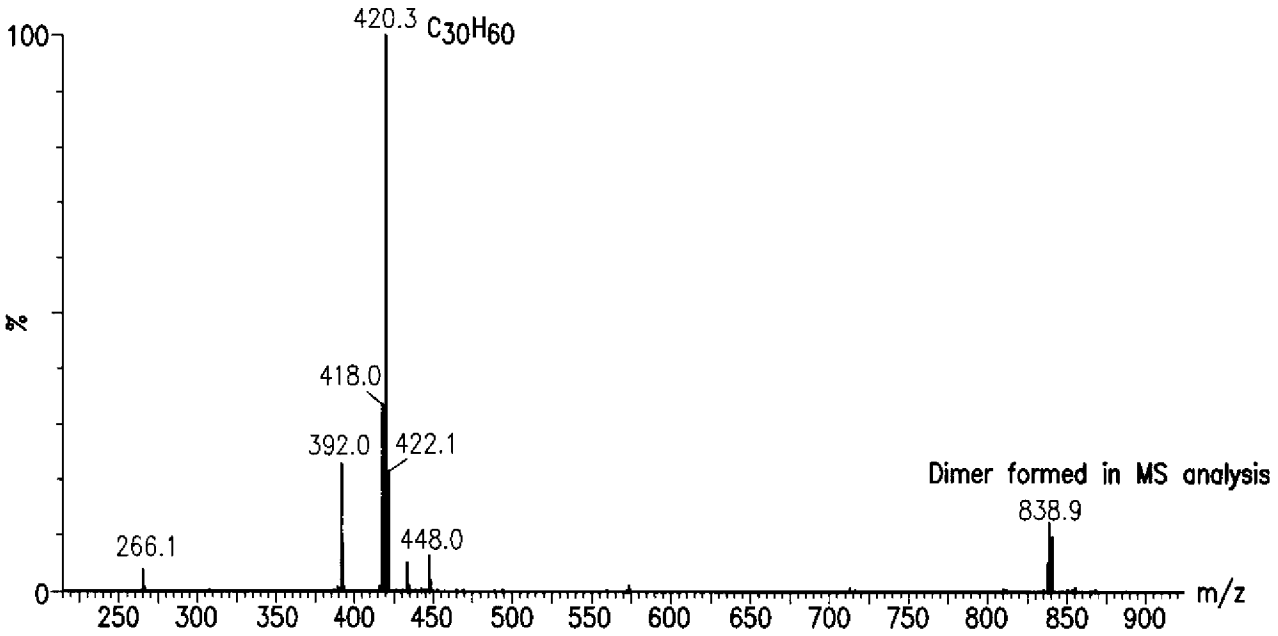
FIG. 3 depicts the mass spectrograph MS of the product of Example $3C_{30}H_{60}$.

In a nitrogen-filled mBraun glove box, to a flask quipped with a stir bar was charged methylaluminoxane (2.89 grams 10 wt % toluene solution) and 1-decene (10 milliliters, FW 140.27, 7.41 grams, 0.053 moles). N,N',N"-trialkyltriazacyclohexane chromium trichloride (0.043 grams) was dissolved in 10 milliliters toluene by stirring and gentle heating. The flask was taken out of glovebox and cooled down by a cold bath equilibrized at −60° C. The catalyst solution was then injected into the flask by a syringe under nitrogen flow. The flask was transferred into a cold bath equilibrized at 0° C. and kept for 48 hours, after which the reaction was quenched by water. The reaction mixture was mixed with Celite™ 545 and filtered to give a clear solution, which was then stripped under vacuum to yield a clear oil. GC, NMR and MS confirmed that the product was decene trimer $C_{30}H_{60}$. FIG. 3 depicts the mass spectrograph MS of the product $C_{30}H_{60}$.

The kinematic viscosity (Kv) of the liquid product was measured using ASTM standards D-445 and reported at temperatures of 100° C. (Kv at 100° C.) or 40° C. (Kv at 40° C.). The viscosity index (VI) was measured according to ASTM standard D-2270 using the measured kinematic viscosities for each product. The viscosity of the product at 100° C. was 3.43 cSt, at 40° C. was 13.53 cSt with viscosity index (VT) of 134.

Example 4

Figure 4:
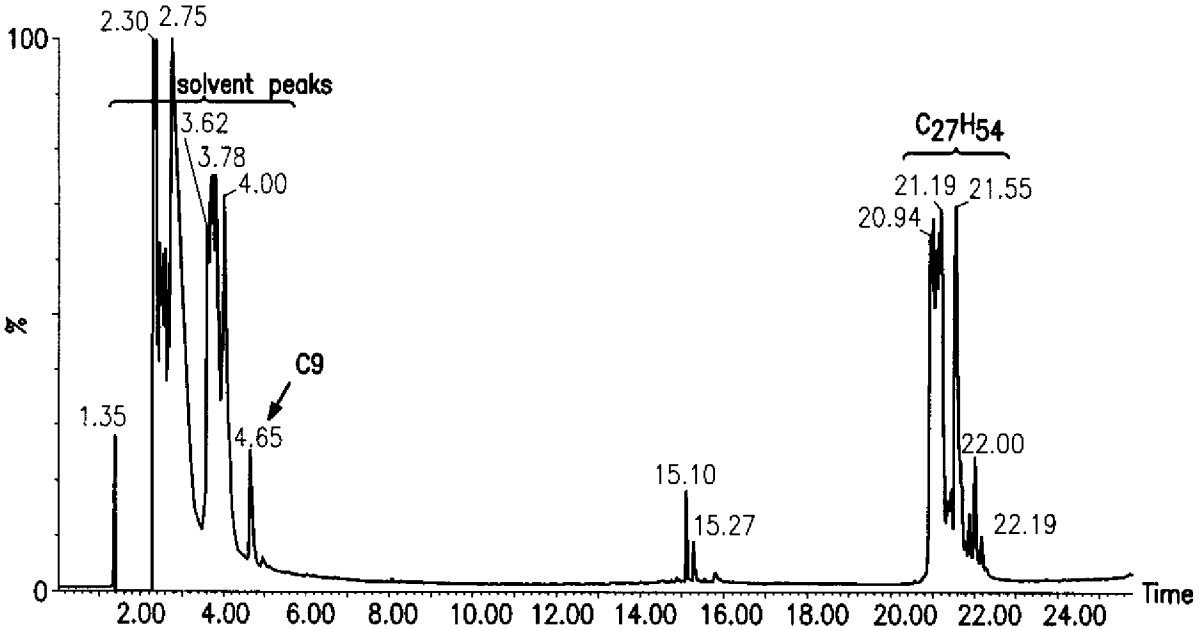
FIG. 4 depicts gas chromatograph-mass spectrograph GC-MS of the product of Example $4C_{27}H_{54}$.

In a nitrogen-filled mBraun glove box, to a 15 milliliter vial equipped with a stir bar was charged methylaluminoxane (1.16 grams 10 wt % toluene solution) and 1-nonene (2.52 grams, FW 126.24, 0.020 mole). The mixture was stirred vigorously at ambient temperature. A toluene solution of a N,N',N"-tridodecyltriazacyclohexane chromium trichloride complex (1.5 grams 1 wt % solution) was then added while stirring. After 18 hours, the reaction was quenched by methanol. GC-MS analysis showed that product is predominantly $C_{27}H_{54}$ (trimer of 1-nonene). FIG. 4 depicts the gas chromatograph-mass spectrograph GC-MS of the product $C_{27}H_{54}$.

The kinematic viscosity (Kv) of the liquid product was measured using ASTM standards D-445 and reported at temperatures of 100° C. (Kv at 100° C.) or 40° C. (Kv at 40° C.). The viscosity index (VI) was measured according to ASTM standard D-2270 using the measured kinematic viscosities for each product. The viscosity of the product $C_{27}H_{54}$ at 100° C. was 2.76 cSt, at 40° C. was 10.23 cSt with viscosity index (VI) of 112.

Example 5

Figure 5:
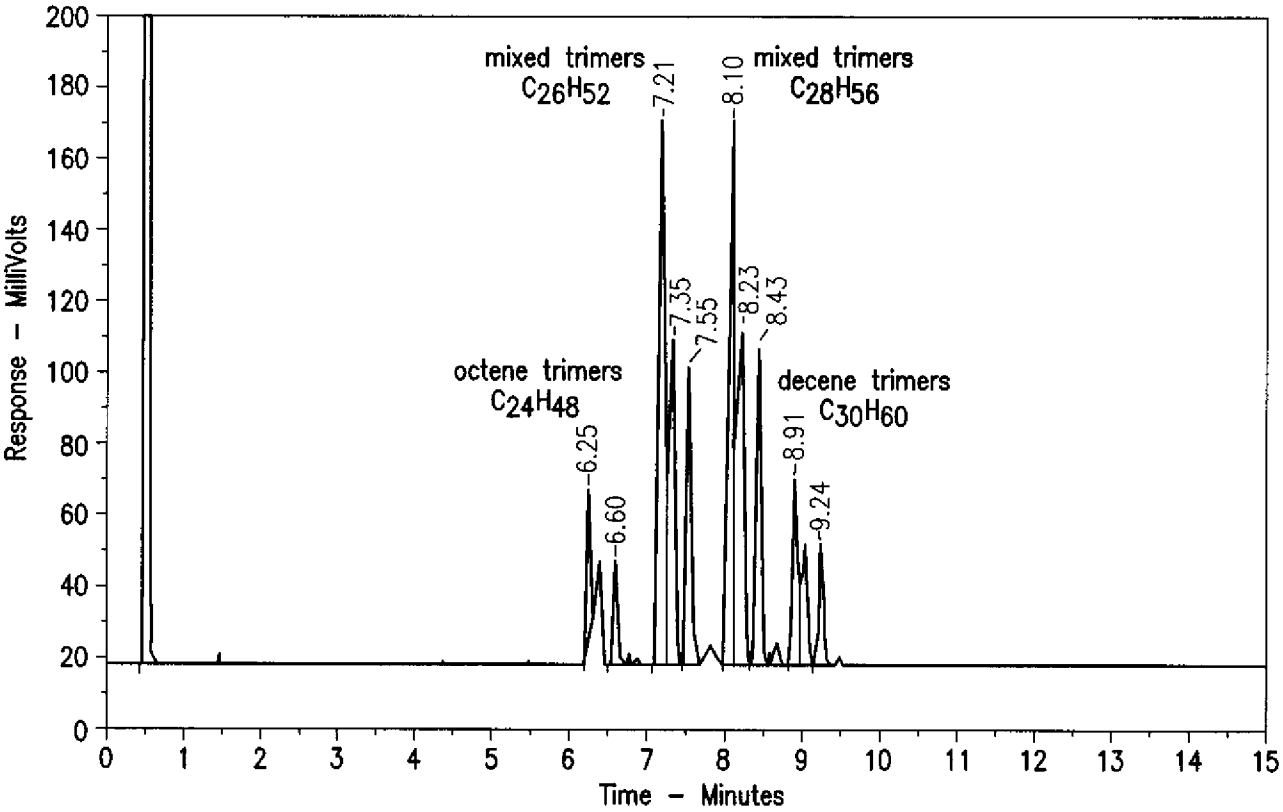
FIG. 5 depicts the mass spectrograph MS of the product of Example 5 showing the presence of various oligomers having $C_{24}$, $C_{26}$, $C_{28}$ and $C_{30}$ carbon numbers.

In a nitrogen-filled mBraun glove box, to a 15 milliliter vial equipped with a stir bar was charged methylaluminoxane (10.34 grams 10 wt % toluene solution), 1-octene (10.0 grams, FW 112.21, 0.089 mole) and 1-decene (12.5 grams, FW 140.27, 0.089 mole). The mixture was stirred vigorously at ambient temperature. A toluene solution of a N,N',N"-tridodecyltriazacyclohexane chromium trichloride complex (0.137 gram, FW 750.44, 0.000178 mole) was then added while stirring. After 18 hours, the reaction was quenched by methanol. GC-MS analysis showed that product consists of $C_{24}$ ($C_8$+$C_8$+$C_8$), $C_{26}$ ($C_8$+$C_8$+$C_{10}$), $C_{28}$ ($C_8$+$C_{10}$+$C_{10}$) and $C_{30}$ ($C_{10}$+$C_{10}$+$C_{10}$) carbon numbers. FIG. 5 depicts a gas chromatograph GC of the product showing the presence of various oligomers having $C_{24}$, $C_{26}$, $C_{28}$ and $C_{30}$ carbon numbers.

The kinematic viscosity (Kv) of the liquid product was measured using ASTM standards D-445 and reported at temperatures of 100° C. (Kv at 100° C.) or 40° C. (Kv at 40° C.). The viscosity index (VI) was measured according to ASTM standard D-2270 using the measured kinematic viscosities for each product. The viscosity of the product at 100° C. was 2.64 cSt, at 40° C. was 9.42 cSt with viscosity index (VI) of 117.

Example 6

Figure 6:
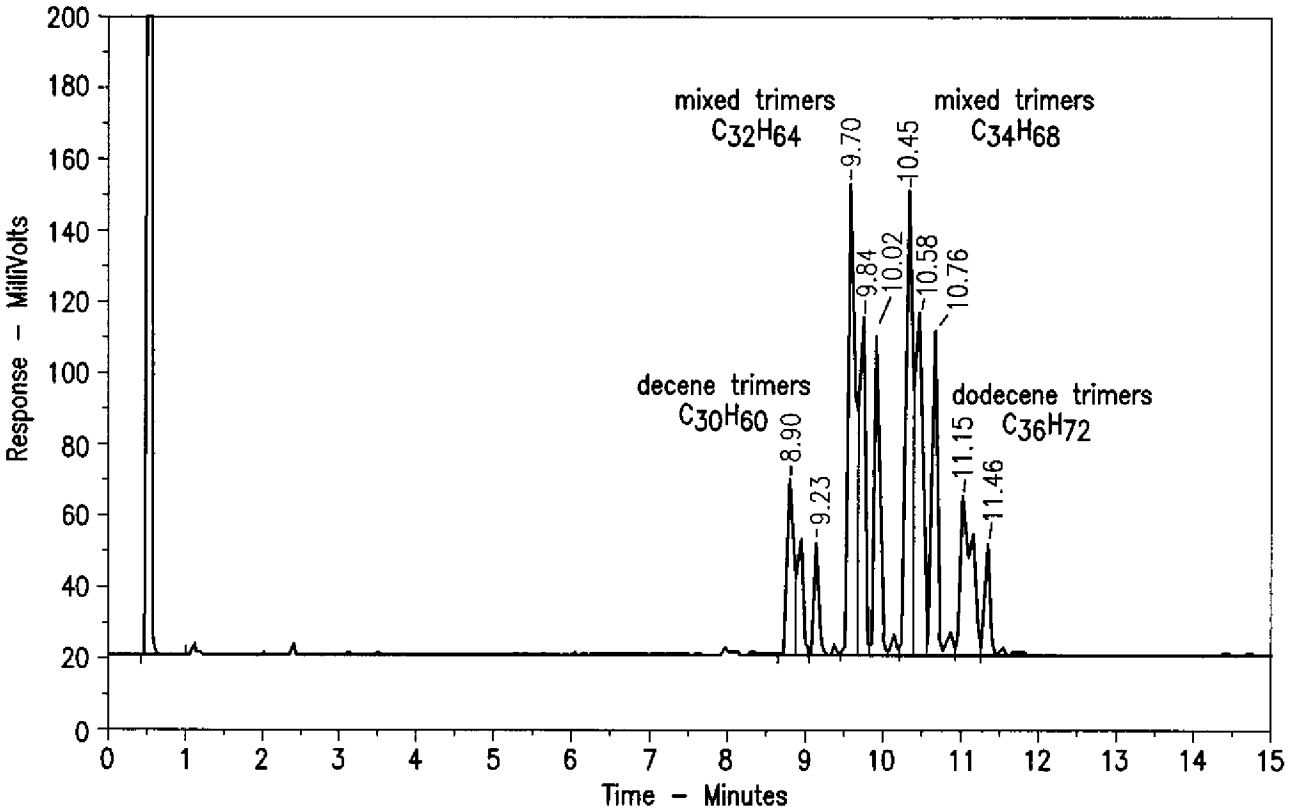
FIG. 6 depicts gas chromatograph-mass spectrograph GC-MS of the product of Example 6 showing the presence of various oligomers having $C_{30}$, $C_{32}$, $C_{34}$ and $C_{36}$ carbon numbers.

In a nitrogen-filled mBraun glove box, to a 15 milliliter vial equipped with a stir bar was charged methylaluminoxane (10.34 grams 10 wt % toluene solution), 1-decene (12.5 grams, FW 140.27, 0.089 mole) and 1-dodecene (15.0 grams, FW 168.32, 0.089 mole). The mixture was stirred vigorously at ambient temperature. A toluene solution of a N,N',N"-tridodecyltriazacyclohexane chromium trichloride complex (0.135 gram, FW 750.44, 0.000178 mole) was then added while stirring. After 18 hours, the reaction was quenched by methanol. GC-MS analysis showed that product consists of $C_{30}$ ($C_{10}$+$C_{10}$+$C_{10}$), $C_{32}$ ($C_{10}$+$C_{10}$+$C_{12}$), $C_{34}$ ($C_{10}$+$C_{12}$+$C_{12}$) and $C_{36}$ ($C_{12}$+$C_{12}$+$C_{12}$) carbon numbers. FIG. 6 depicts a gas chromatograph GC of the product showing the presence of various oligomers having $C_{30}$, $C_{32}$, $C_{34}$ and $C_{36}$ carbon numbers.

The kinematic viscosity (Kv) of the liquid product was measured using ASTM standards D-445 and reported at temperatures of 100° C. (Kv at 100° C.) or 40° C. (Kv at 40° C.). The viscosity index (VI) was measured according to ASTM standard D-2270 using the measured kinematic viscosities for each product. The viscosity of the product at 100° C. was 3.76 cSt, at 40° C. was 15.16 cSt with viscosity index (VI) of 144.

PCT and EP Clauses:

1. A process for the oligomerization of $C_6$-$C_{24}$ alpha-olefins to give a polyolefin product comprising at least 50 mole % of alphaolefin trimers, wherein said process comprises contacting two or more $C_6$-$C_{24}$ alpha-olefins with a catalyst in a solvent at a temperature below 120° C. and under reaction conditions sufficient to produce the alphaolefin trimers; wherein the polyolefin product has a viscosity ($Kv_{100}$) from 2 to 8 cSt at 100° C., and a viscosity index (VI) from 100 to 160; and wherein the polyolefin product comprises at least two alphaolefin trimers, each having a different total carbon number.

2. The process of clause 1 wherein the polyolefin product has a Noack volatility of no greater than 20 percent.

3. The process of clauses 1 or 2 wherein the two or more $C_6$-$C_{24}$ alpha-olefins comprise singly two or more of 1-decene, 1-octene, 1-dodecene, 1-hexene, 1-tetradecene, 1-octadecene, 1-hexadecene, and 1-eicosene, or a mixture comprising two or more of 1-decene, 1-octene, 1-dodecene, 1-hexene, 1-tetradecene, 1-octadecene, 1-hexadecene, and 1-eicosene.

4. The process of clauses 1-3 wherein the catalyst comprises a complex of a chromium compound and a 1,3,5-triazacyclohexane.

5. The process of clause 4 wherein the catalyst additionally comprises an alkyl alumoxane.

6. The process of clauses 1-5 wherein the polyolefin product comprises at least four alphaolefin trimers, each having a different total carbon number.

7. The process of clauses 1-6 wherein each alphaolefin trimer has a total carbon number selected from $C_{13}$, $C_{19}$, $C_{20}$, $C_{21}$, $C_{22}$, $C_{23}$, $C_{24}$, $C_{25}$, $C_{26}$, $C_{27}$, $C_{28}$, $C_{29}$, $C_{30}$, $C_{31}$, $C_{32}$, $C_{33}$, $C_{34}$, $C_{35}$, $C_{36}$, $C_{37}$, $C_{38}$, $C_{39}$, $C_{40}$, $C_{41}$, $C_{42}$, $C_{43}$, $C_{44}$, $C_{45}$, $C_{46}$, $C_{47}$, $C_{48}$, $C_{49}$, $C_{50}$, $C_{51}$, $C_{52}$, $C_{53}$, $C_{54}$, $C_{55}$, $C_{56}$, $C_{57}$, $C_{58}$, $C_{59}$ and $C_{60}$.

8. The process of clauses 1-6 wherein each alphaolefin trimer has a total carbon number selected from $C_{24}$, $C_{25}$, $C_{26}$, $C_{27}$, $C_{28}$, $C_{29}$, $C_{30}$, $C_{31}$, $C_{32}$, $C_{33}$, $C_{34}$, $C_{35}$ and $C_{36}$.

9. The process of clauses 1-6 wherein at least one alphaolefin trimer has a total carbon number selected from $C_{19}$, $C_{21}$, $C_{23}$, $C_{25}$, $C_{27}$, $C_{29}$, $C_{31}$, $C_{33}$, $C_{35}$, $C_{37}$, $C_{39}$, $C_{41}$, $C_{43}$, $C_{45}$, $C_{47}$, $C_{49}$, $C_{51}$, $C_{53}$, $C_{55}$, $C_{57}$ and $C_{59}$.

10. The process of clauses 1-6 wherein at least one alphaolefin trimer has a total carbon number selected from $C_{25}$, $C_{27}$, $C_{29}$, $C_{31}$, $C_{33}$ and $C_{35}$.

11. The process of clauses 1-10 wherein the polyolefin product comprises at least 75 mole % of alphaolefin trimers.

12. A polyolefin product produced by the process of clauses 1-11.

13. The process of clauses 1-11 further comprising hydrogenating the polyolefin product to form a lubricating oil base stock.

14. A lubricating oil base stock produced by the process of clause 13.

15. A lubricating oil comprising a lubricating oil base stock, said lubricating oil base stock prepared by the process of clause 13.

All patents and patent applications, test procedures (such as ASTM methods, UL methods, and the like), and other documents cited herein are fully incorporated by reference to the extent such disclosure is not inconsistent with this disclosure and for all jurisdictions in which such incorporation is permitted.

When numerical lower limits and numerical upper limits are listed herein, ranges from any lower limit to any upper limit are contemplated. While the illustrative embodiments of the disclosure have been described with particularity, it will be understood that various other modifications will be apparent to and can be readily made by those skilled in the art without departing from the spirit and scope of the disclosure. Accordingly, it is not intended that the scope of the claims appended hereto be limited to the examples and descriptions set forth herein but rather that the claims be construed as encompassing all the features of patentable novelty which reside in the present disclosure, including all features which would be treated as equivalents thereof by those skilled in the art to which the disclosure pertains.

The present disclosure has been described above with reference to numerous embodiments and specific examples. Many variations will suggest themselves to those skilled in this art in light of the above detailed description. All such obvious variations are within the ill intended scope of the appended claims.

What is claimed is:

1. A process for the oligomerization of $C_6$-$C_{24}$ alpha-olefins to give a polyolefin product comprising at least 50 mole % of alphaolefin trimers, wherein said process comprises contacting two or more $C_6$-$C_{24}$ alpha-olefins with a catalyst in a solvent at a temperature between 25° C. and 120° C. and under reaction conditions sufficient to produce the alphaolefin trimers, wherein the catalyst comprises a single site trimerization catalyst; wherein the polyolefin product has a viscosity ($Kv_{100}$) from 2 to 8 cSt at 100° C., and a viscosity index (VI) from 100 to 160; and wherein the polyolefin product comprises at least two alphaolefin trimers, each having a different total carbon number.

2. The process of claim 1 wherein the polyolefin product has a Noack volatility of no greater than 20 percent.

3. The process of claim 1 wherein the two or more $C_6$-$C_{24}$ alpha-olefins comprise singly two or more of 1-decene, 1-octene, 1-dodecene, 1-hexene, 1-tetradecene, 1-octadecene, 1-hexadecene, and 1-eicosene, or a mixture comprising two or more of 1-decene, 1-octene, 1-dodecene, 1-hexene, 1-tetradecene, 1-octadecene, 1-hexadecene, and 1-eicosene.

4. The process of claim 1 wherein the catalyst comprises a complex of a chromium compound and a 1,3,5-triazacyclohexane.

5. The process of claim 1 wherein the catalyst comprises a complex of chromium halide and a 1,3,5-triazacyclohexane.

6. The process of claim 1 wherein the catalyst additionally comprises an alkyl alumoxane.

7. The process of claim 1 wherein the polyolefin product comprises at least four alphaolefin trimers, each having a different total carbon number.

8. The process of claim 1 wherein each alphaolefin trimer has a total carbon number selected from $C_{18}$, $C_{19}$, $C_{20}$, $C_{21}$, $C_{22}$, $C_{23}$, $C_{24}$, $C_{25}$, $C_{26}$, $C_{27}$, $C_{28}$, $C_{29}$, $C_{30}$, $C_{31}$, $C_{32}$, $C_{33}$, $C_{34}$, $C_{35}$, $C_{36}$, $C_{37}$, $C_{38}$, $C_{39}$, $C_{40}$, $C_{41}$, $C_{42}$, $C_{43}$, $C_{44}$, $C_{45}$, $C_{46}$, $C_{47}$, $C_{48}$, $C_{49}$, $C_{50}$, $C_{51}$, $C_{52}$, $C_{53}$, $C_{54}$, $C_{55}$, $C_{56}$, $C_{57}$, $C_{58}$, $C_{59}$ and $C_{60}$.

9. The process of claim 1 wherein each alphaolefin trimer has a total carbon number selected from $C_{24}$, $C_{25}$, $C_{26}$, $C_{27}$, $C_{28}$, $C_{29}$, $C_{30}$, $C_{31}$, $C_{32}$, $C_{33}$, $C_{34}$, $C_{35}$ and $C_{36}$.

10. The process of claim 1 wherein at least one alphaolefin trimer has a total carbon number selected from $C_{19}$, $C_{21}$, $C_{23}$, $C_{25}$, $C_{27}$, $C_{29}$, $C_{31}$, $C_{33}$, $C_{35}$, $C_{37}$, $C_{39}$, $C_{41}$, $C_{43}$, $C_{45}$, $C_{47}$, $C_{49}$, $C_{51}$, $C_{53}$, $C_{55}$, $C_{57}$ and $C_{59}$.

11. The process of claim 1 wherein at least one alphaolefin trimer has a total carbon number selected from $C_{25}$, $C_{27}$, $C_{29}$, $C_{31}$, $C_{33}$ and $C_{35}$.

12. The process of claim 1 wherein the polyolefin product comprises at least 75 mole % of alphaolefin trimers.

13. A polyolefin product produced by the process of claim 1.

14. The process of claim 1 further comprising hydrogenating the polyolefin product to form a lubricating oil base stock.

15. A lubricating oil base stock produced by the process of claim 14.

16. A lubricating oil comprising a lubricating oil base stock, said lubricating oil base stock prepared by the process of claim 14.

17. The lubricating oil of claim 16 wherein the lubricating oil base stock is present in an amount from 85 weight percent to 99 weight percent, based on the total weight of the lubricating oil.

18. The lubricating oil of claim 16 wherein the lubricating oil further comprises one or more of a viscosity improver, antioxidant, detergent, dispersant, pour point depressant, corrosion inhibitor, metal deactivator, seal compatibility additive, anti-foam agent, inhibitor, and anti-rust additive.

19. The lubricating oil of claim 16 which is a passenger vehicle engine oil.

* * * * *